US005996847A

United States Patent [19]

Smolen, Jr. et al.

[11] Patent Number: 5,996,847

[45] **Date of Patent: *Dec. 7, 1999**

[54] PISTON/NOZZLE ASSEMBLY FOR SIMULTANEOUS PUMP DISPENSER

[75] Inventors: Richard J. Smolen, Jr., Woodstock, Ill.; George M. Bachand, Plantsville, Conn.

[73] Assignee: Owens-Illinois Closure Inc., Toledo, Ohio

[ * ] Notice: This patent is subject to a terminal disclaimer.

[21] Appl. No.: 08/855,794

[22] Filed: May 12, 1997

Related U.S. Application Data

[63] Continuation of application No. 08/552,646, Nov. 3, 1995, Pat. No. 5,683,014.

[51] Int. Cl.[6] ..... B67D 5/52

[52] U.S. Cl. ..... 222/137; 222/383.1; 239/304; 239/306; 239/333

[58] Field of Search ..... 222/136, 137, 222/145.1, 145.3, 145.5, 383.1; 239/304, 306, 333

[56] References Cited

U.S. PATENT DOCUMENTS

| | | | |
|---|---|---|---|
| 5,009,342 | 4/1991 | Lawrence et al. | 222/136 |
| 5,152,461 | 10/1992 | Proctor | 239/304 |
| 5,439,141 | 8/1995 | Clark et al. | 222/136 |
| 5,472,119 | 12/1995 | Park et al. | 222/145.8 |
| 5,535,950 | 7/1996 | Barriac et al. | 239/304 |
| 5,562,250 | 10/1996 | O'Neill | 239/304 |
| 5,683,014 | 11/1997 | Smolen, Jr. et al. | 222/137 |

*Primary Examiner*—Joseph A. Kaufman

[57] ABSTRACT

The assembly comprises a pair of substantially identical unitary plastic molded units, each unit having a tubular stem formed with a piston at one end and a nozzle head at the other. Each unit has a female snap-type connector facing to one side and spaced therefrom a male snap-type connector facing to the same side, the molded units being disposed side-by-side with the male snap-type connectors snappingly received into the female snap-type connectors of the respective stems.

7 Claims, 5 Drawing Sheets

PISTON/NOZZLE ASSEMBLY FOR SIMULTANEOUS PUMP DISPENSER

This application is a continuation of application Ser. No. 08/552,646, filed Nov. 3, 1995; now U.S. Pat. No. 5,683, 014.

BACKGROUND OF THE INVENTION

This invention relates to a piston/nozzle assembly for a pump dispenser for simultaneous dispensing of two separate liquids. More specifically, this invention is concerned with the structure of two substantially similar piston/nozzle units formed into a single sturdy and durable assembly.

The Bachand dispenser of the above mentioned patent includes a pair of side-by-side forwardly facing cylinders with a cylinder-type vent valve below each cylinder. Fitting into the separate cylinders and vent valves are pistons which are part of a piston/nozzle assembly disclosed in simple form in the Bachand application. These assemblies comprise a pair of side-by-side main pistons fitting into the main cylinders, stems extending forwardly from the pistons, and nozzle heads/caps disposed at the forward ends of the stems. The stems individually are provided with depending valve pistons which fit into the vent cylinders described above. A trigger-type actuator pivots down from above the cylinders in the dispenser of Bachand and engages the piston/nozzle assembly so that when the trigger is squeezed, the pistons will move into the cylinders and a pumping will be affected driving liquid through the stems toward the dispenser nozzles.

In the Bachand application the two piston/nozzle units are held in assembly by a bridging member extending between and connected to the respective stems. A spring is based between the main cylinders and extends forward to the bridge element which also forms a platform for the forward end of the spring to work against.

The present invention presents a structure which facilitates the assembly of the piston/nozzle units together in a single assembly. It provides a reliable joining of the two units by means of a dual head/socket arrangement. Once the assembly is properly joined, its integral structure is sturdy and serviceable.

SUMMARY OF THE INVENTION

The present invention for a simultaneous pump dispenser is a piston/nozzle assembly comprising a pair of substantially identical unitary plastic molded units, each unit being defined by a tubular stem having a piston at one end and a nozzle head at the other, the ends of the stem terminating in openings at the ends of the respective piston and nozzle head. The units each include on the stems a female snap-type connector facing laterally to one side and spaced therefrom a male snap-type connector facing to the same side, the molded units being disposed side-by-side with the male snap-type connectors snappingly received into the female snap-type connectors of the respective stems.

BRIEF DESCRIPTION OF THE DRAWINGS

Further objects and features of the invention will be apparent to those skilled in the art from a study of the following specification and the accompanying drawings, all of which disclose a non-limiting embodiment of the invention. In the drawings.

DESCRIPTION OF THE PREFERRED EMBODIMENTS

Figure 1:
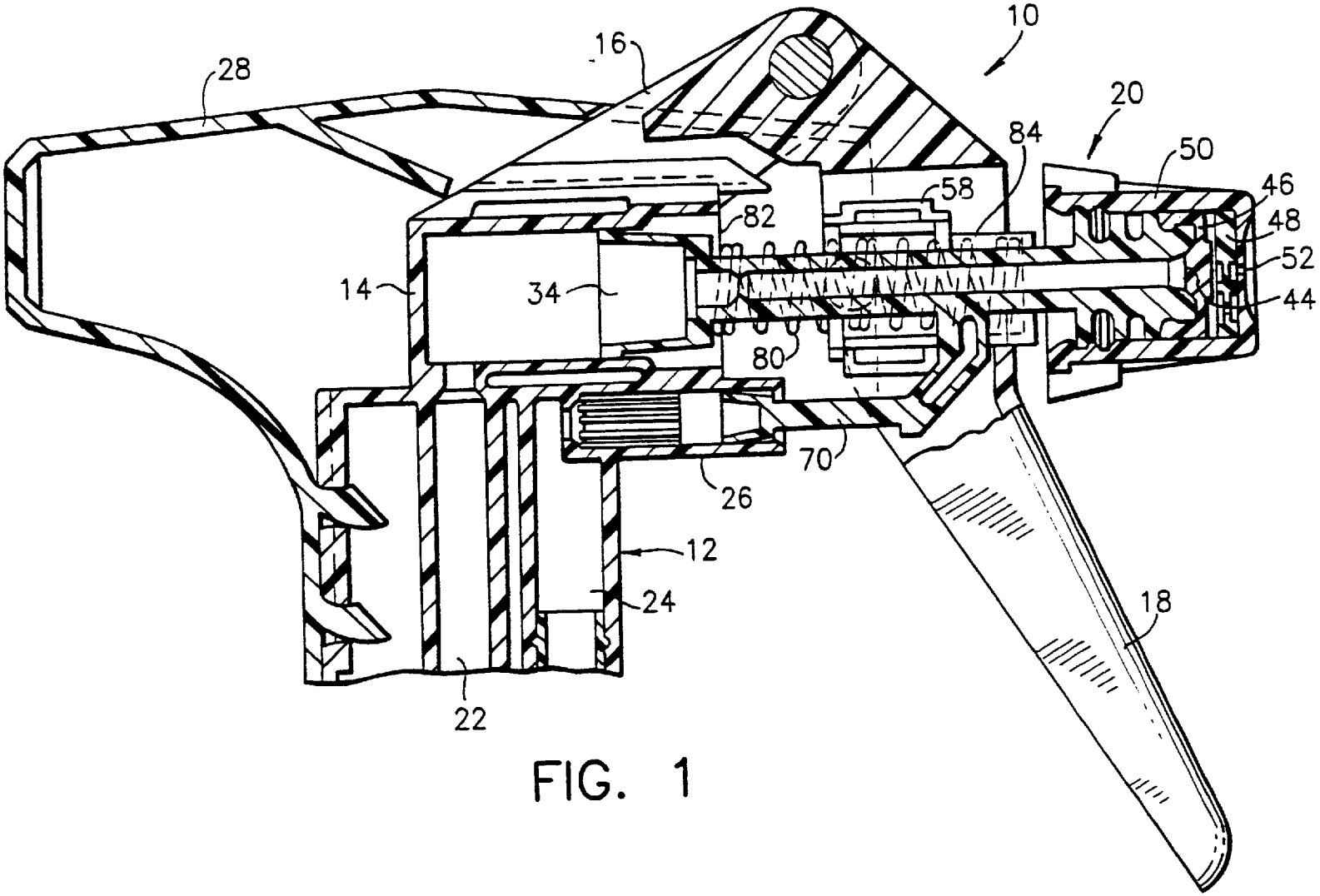
FIG. 1 is a fragmentary sectional view of the pump of a dispenser embodying the invention. The section is taken along the axis of the nearer piston/nozzle assembly on line 1—1 of FIG. 8.

A pump dispenser embodying the invention is shown in FIG. 1 and generally designated 10. It comprises a unitary support member 12 supporting a pair of side-by-side cylinders 14 unitary with which is molded a trigger arm 16. Pivoted to the top of the arm is the trigger or lever 18 which engages the piston/discharge nozzle assembly 20.

The support member 12 includes a central riser 22 communicating with the inside of the cylinder 14. A vent passage 24 is provided in the support member 12 and communicates with an internally grooved vent cylinder 26.

As the cylinders 14 are disposed in side-by-side relation, so are the vent valve cylinders 26 positioned under the respective main cylinders 14. The streamlined guard or cowling 28 is secured to the support 12 by means discussed in detail in the Bachand application.

Turning now to the dual piston/nozzle assembly (FIGS. 2 and 3), it comprises a right hand piston/nozzle unit 30 and a left hand piston/nozzle unit 30'. Each of these units comprise a cup-shaped piston 34, 34', at one end of a tubular stem 36, 36', the bore of which communicates with the piston (FIG. 1) and at the opposite end the nozzle head 38, 38'.

A nozzle check cup 40, 40' is provided. The heads 38, 38' are formed with spaced peripheral flanges 42, 42', and the cups 40, 40' snap onto the more forward of the flanges which are of smaller diameter than the others as is well known in the art, for instance, in the McKinney U.S. Pat. No. 4,227, 650. The check cups include offset apertures and central plugs 44, 44' which normally plug the end openings in the heads 38, 38'.

A nozzle cap 50 is provided to cover both the heads 38, 38' and a detent on the inside sidewall as shown fits between the flanges selectively to determine whether the outlet is off or permits discharge in the form of a spray. When the cap 50 is in forward spraying position, pressure of liquid within the stems 36, 36' move the plugs 44,44' forward to permit discharge of liquid through offset openings 46, 46' in the check cups.

The liquid then moves into a swirl chamber disposed between a spacer 48 (FIG. 1) and the front wall of the nozzle cap 50. From the swirl chamber liquid passes through the discharge orifice 52 in the cap. Alternatively, when the cap 50 is in the position shown, the plugs 44, 44' are held in a rearward position and there is no discharge.

Figure 9:
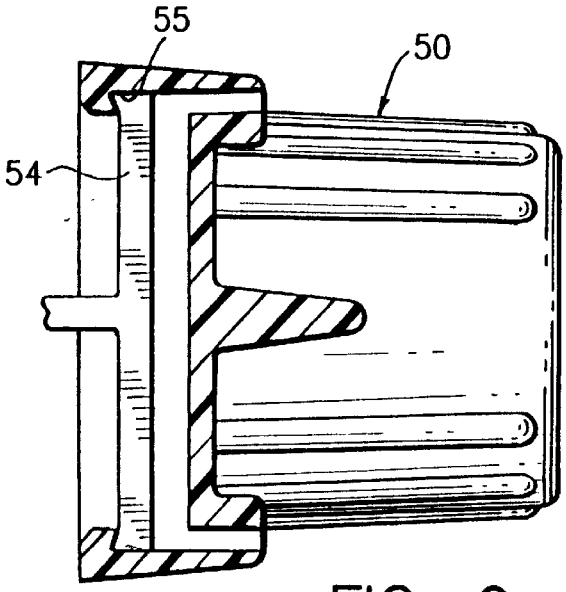
FIG. 9 is a sectional view taken on the line 9—9 of FIG. 8.

To retain the cap 50 in place on the nozzle heads 38, 38', while still permitting the axial movement described above, the two stems 36, 36' and rear flanges 42, 42' are formed with vertical retaining plates 54, 54' which form a single plate in assembly, the plate snapping to a retaining cavity 55 in the rear of the cap 50 (FIG. 9). As shown, the rear edge of the cavity has an undercut shoulder which receives a rearward lip on the upper and lower ends of the plates 54, 54'.

Figure 6:
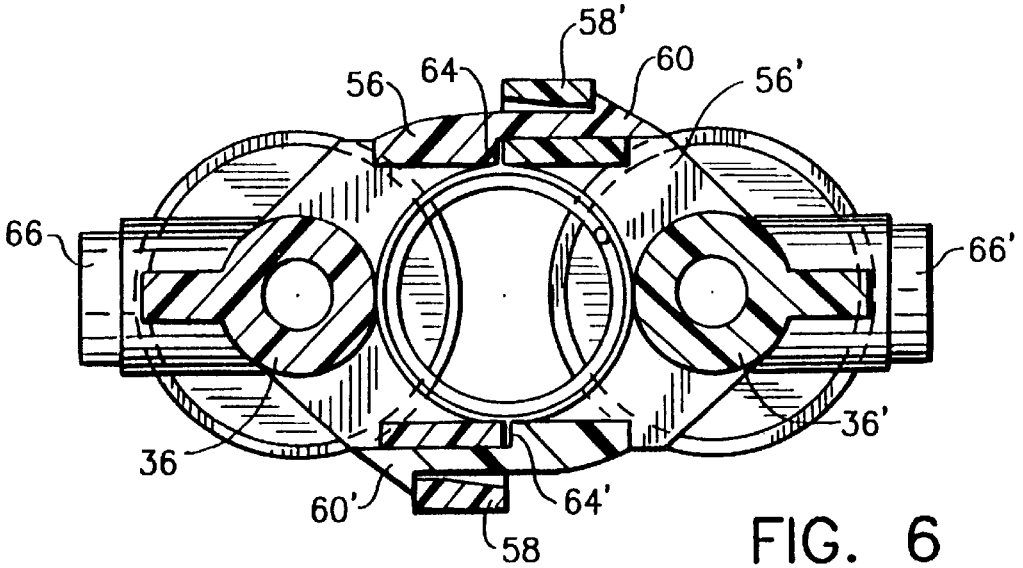
FIG. 6 is a sectional view on the line 6—6 of FIG. 4.

Each of the units 30, 30' are provided with similar connecting configurations. These comprise opposed frames 56, 56'. These frames which are unitarily molded with the respective stems 36, 36' comprise the rectangular female sockets 58 58' (FIG. 6). The frames also comprise on the opposite sides of the respective stems the lateral tongue-like male heads 60, 60'. The heads 60, 60' are formed with barbs so that when the tongue-like heads extend into the respective sockets, these barbs snap past the sockets to hold the units together in assembly.

The frames 56, 56' also include transverse platform segments 62, 62' which are integral with the respective stems and partly supported by curved walls 64, 64', part of the frames 56, 56'. Trunnions 66, 66' extend out from opposite sides of the respective stems 30, 30' and are supported by reinforcing webs 68, 68'.

Figure 2:
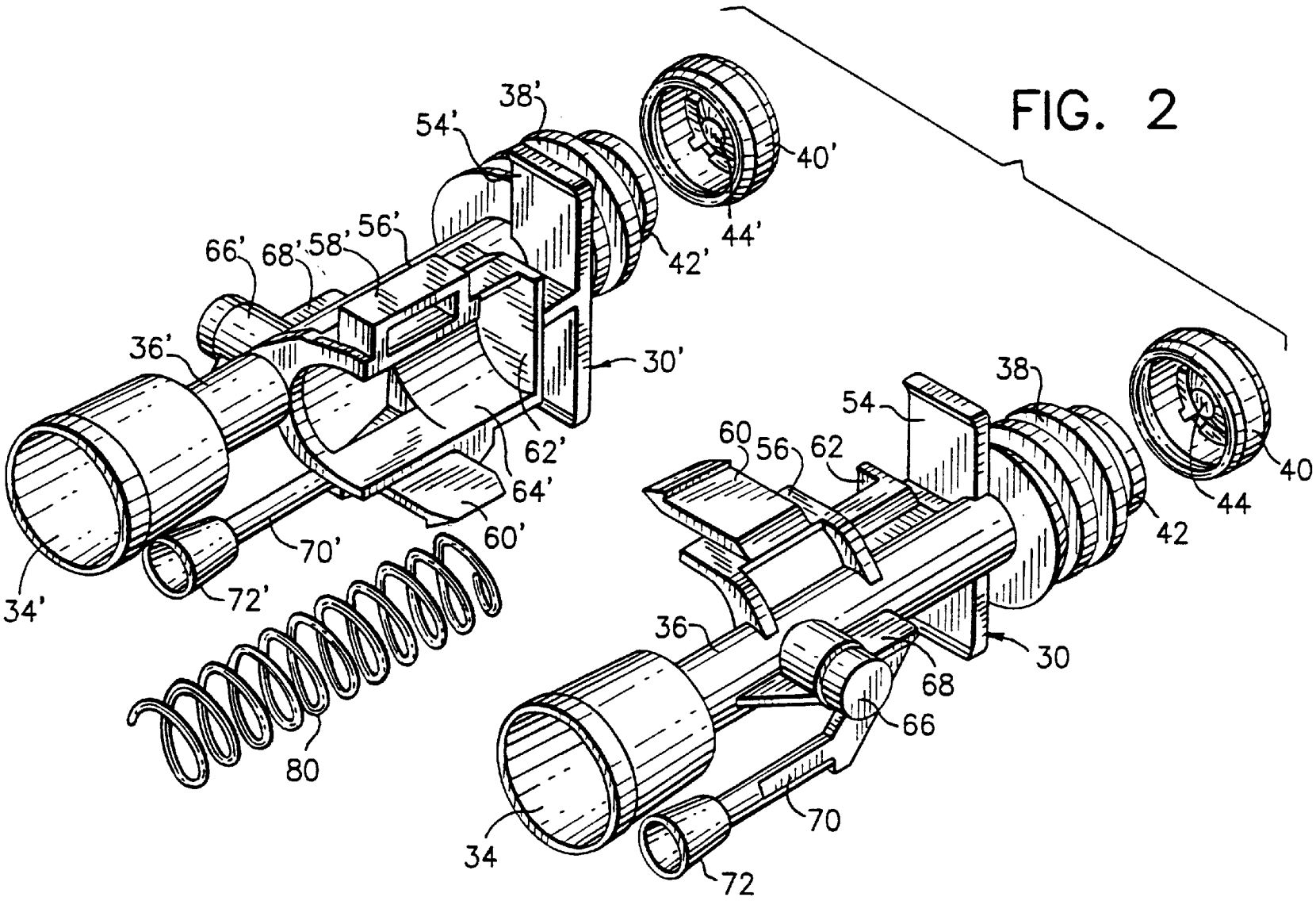
FIG. 2 is an enlarged exploded view in perspective of two piston/nozzle units prior to complete assembly.
Figure 3:
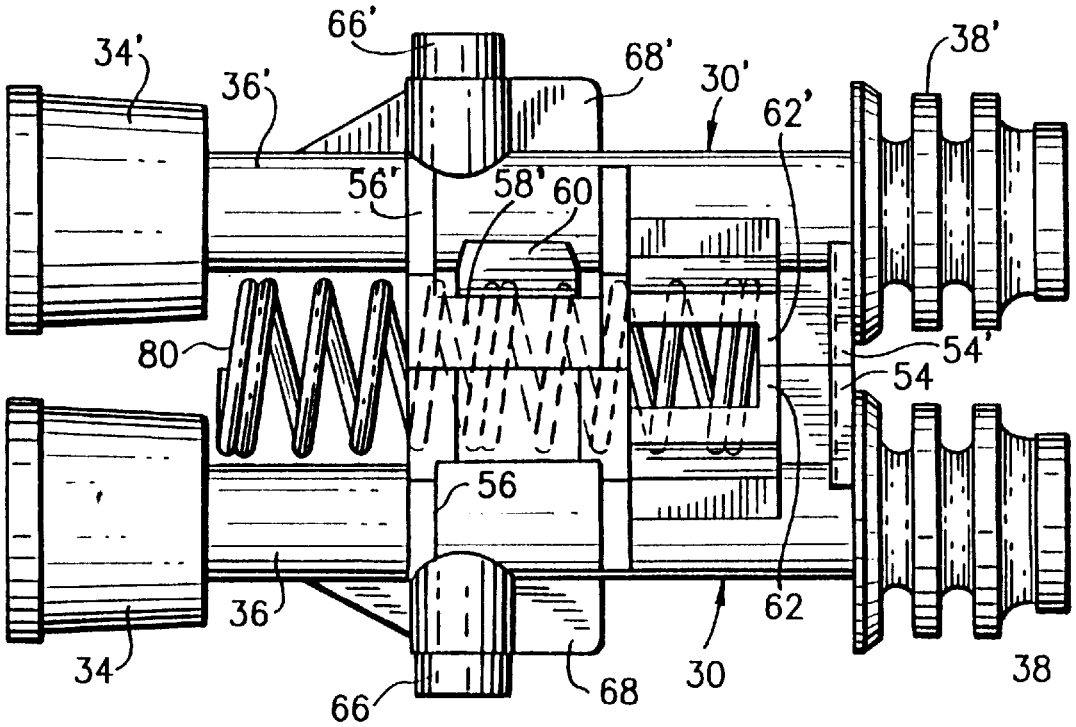
FIG. 3 is a top plan view of an assembly embodying the invention showing the spring partly in phantom.

The structures of the two units 30, 30' thus far described are substantially identical. One unit in FIG. 2 is rotated 180° about its own axis so that the connectors 58, 58' and 60, 60' face each other. By virtue of this alignment, the two units may be pushed together laterally so that the tongue-like head 60, 60' of one unit enters the socket 58, 58' of the other unit. The respective tongues are thus inserted into the respective sockets and then pressed home so that the barbs at the end of the heads snap past the ends of the sockets. In this position the walls 64,64' on the tongue-like heads engage against the side edge of the sockets and the two partial platforms 62, 62' engage edgewise to further assist in stabilizing the connection and integration of the units 30, 30' in assembly.

Figure 4:
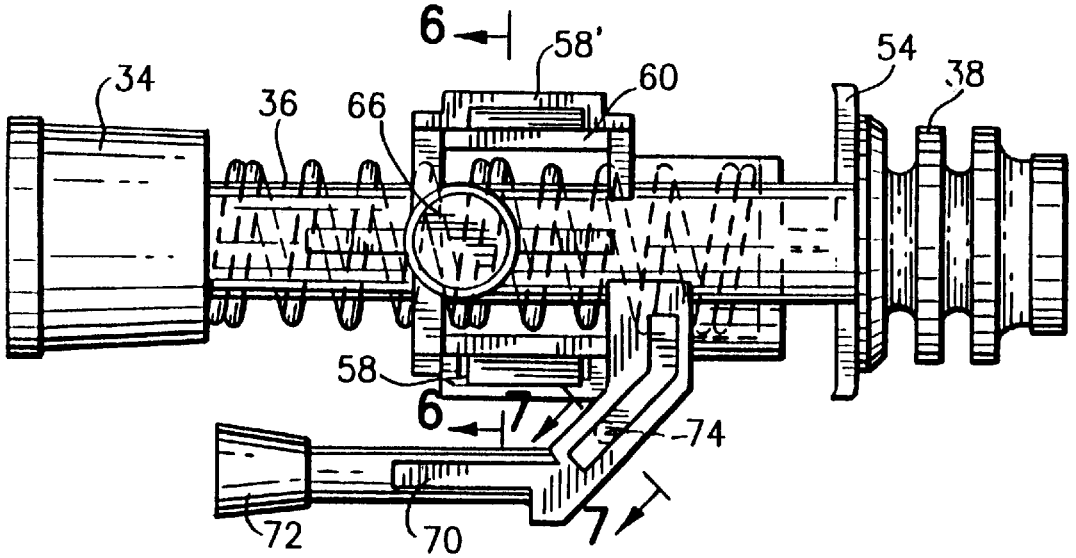
FIG. 4 is a side elevational view showing the spring partly in phantom.
Figure 5:
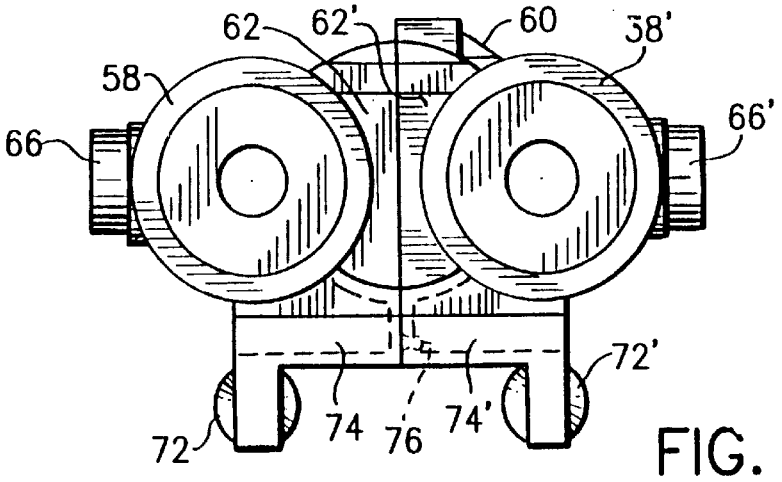
FIG. 5 is a front elevational view of the subassembly.
Figure 7:
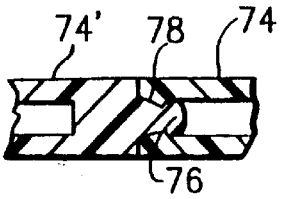
FIG. 7 is a fragmentary sectional view showing the connection between the sideward extensions of the vent piston arms of the units comprising the assembly.
Figure 8:
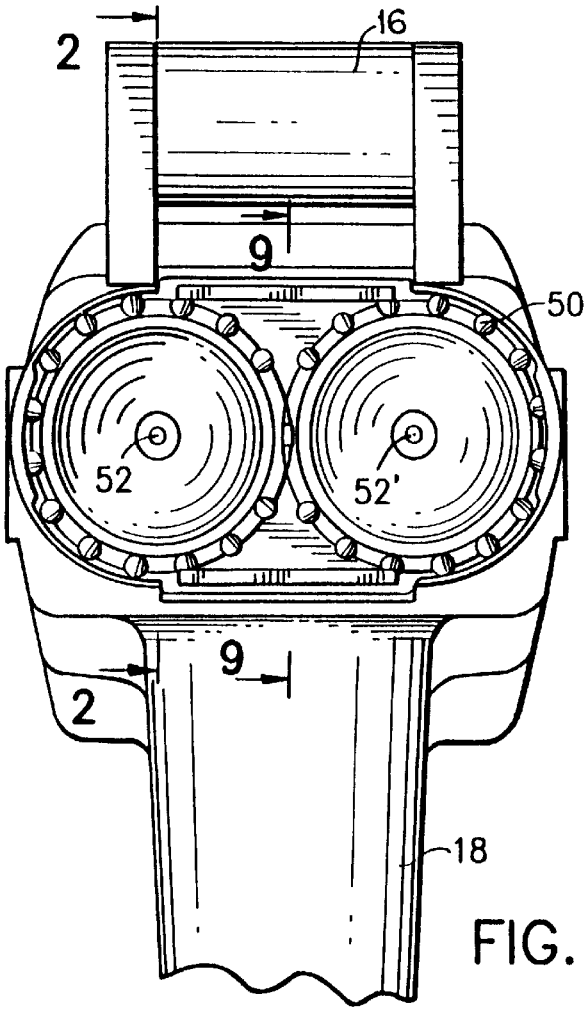
FIG. 8 is an enlarged fragmentary front plan view.

Additional parts of the two units are not identical in the two units. As will be noted from FIGS. 2, 4 and 5, from the lower surface of the tubular stems 36, 36' support arms 70, 70' extend down and rearwardly and terminate in resilient pistons 72, 72'. The arms are each provided with a lateral stabilizing extension 74, 74' which, as shown in FIG. 7, terminate inwardly in a head 76 and socket 78 respectively. In the assembly oper- ation the lateral extensions are aligned so that in the final thrust home, the head and socket 76, 78 of the respective extensions snap together to further stabilize the assembly.

As shown in FIG. 1, when the assembly 20 is inserted into position in the dispenser pump, the pistons 34, 34' fit respectively into the two cylinders 14, and the vent valve pistons 72, 72' move into the vent valve cylinders 26, all as described in the Bachand application. In the assembly the spring 80 is placed in position with its forward end against platform 62, 62' and its rearward end disposed against a spring base 82 between the two cylinders 14. The lever or trigger 18, pivoted at its upper end on the arm 16, has a central opening which receives the assembly 20 and is provided with a finger 84 on either side of the opening, the fingers engaging the two trunnions 66, 66' on the opposite sides of the assembly 20.

Thus, when the lever 18 is squeezed toward the support member 12, the pistons 34, 34' and 72, 72' are driven inward into the respective pairs of cylinders 14 and 26 to pump liquid from the cylinders forward through the stems 36, 36' and out the orifice or orifices 52. As the vent valve pistons 72, 72' move rearward in the pairs of cylinders 26, they encounter the grooved inner surface thereof and pass air to move into the container through the vent passages 24. Upon release of the lever 18, the spring 80 will drive the assembly 20 forwardly, creating a vacuum in the cylinders 14, priming them for the next pumping stroke, and the pistons 72, 72' will move forward out of the grooved area of cylinder 26 to seal the vents.

The invention described here may take a number of forms. It is not limited to the embodiment disclosed but is of a scope defined by the following claim language which may be broadened by an extension of the right to exclude others from making, using or selling the invention as is appropriate under the doctrine of equivalents.

What is claimed is:

1. For a simultaneous pump dispenser a piston/nozzle assembly comprising a pair of similar unitary plastic molded units, each defined by:

a. a tubular stem having a piston at one end and a nozzle head at the other, the ends of the stem terminating in openings at the ends of the respective piston and head, b. an element of a snap-type connector facing laterally on one side of the tubular stem intermediate its ends, the molded units being disposed side-by-side with the elements of the snap-type connectors of the respective stems snappingly engaging each other to hold the assembly firmly together.

2. A piston/nozzle assembly as claimed in claim 1 including additionally a cup-shaped resilient check valve cup disposed over the nozzle head and being formed with an O-ring about its mouth which fits into a peripheral groove about the head, a central plug which normally blocks the opening in the nozzle head, and outlet openings to the side of the plug, and an orifice cap covers the nozzle end including the check valve, the cap also being cup-shaped and having an orifice in its end wall and a retainer for holding the cap on the head.

3. A piston/nozzle assembly as claimed in claim 1, the snap-type connectors comprising a female connector with a beveled lead-in and the a connector having a barbed end, the lead-in and the barb resiliently yielding in the connection to effect the snap reception, and a spacer is provided to hold the units in firm spaced parallel relation when the units are together.

4. A piston/nozzle assembly as claimed in claim 3 wherein the units of the assembly each have a downward arm extending from intermediate the ends of the stem and extending downward and in the direction of the piston and terminating in a secondary piston, the arms on the two units having projections directed toward each other and terminating in mating snap fastener parts to further hold the subassembly together.

5. A simultaneous pump dispenser having a pair of side-by-side pumping cylinders and an assembly comprising a pair of similar unitary plastic molded units, each defined by:

a. a tubular stem having a piston at one end and a nozzle head at the other, the ends of the stem terminating in openings at the ends of the respective piston and head, b. an element of a snap-type connector facing laterally on one side of the tubular stem intermediate its ends, the molded units being disposed side-by-side with the elements of the snap-type connectors of the respective stems snappingly engaging each other to hold the assembly firmly together, the pistons being disposed in the cylinders.

6. A simultaneous pump dispenser as claimed in claim 5, the snap-type connectors comprising a female connector with a beveled lead-in and a male connector having a barbed end, the lead-in and the barb resiliently yielding in the connection to effect the snap reception, and a spacer is provided to hold the units in firm spaced parallel relation when the units are together.

7. A simultaneous pump dispenser as claimed in claim 6 wherein the units of the assembly each have a downward arm extending from intermediate the ends of the stem and extending downward and in the direction of the piston and terminating in a secondary piston, the arms on the two units having projections directed toward each other and terminating in mating snap fastener parts to further hold the subassembly together.

* * * * *